US005873756A

United States Patent [19]

Takayanagi

[11] Patent Number: 5,873,756

[45] Date of Patent: Feb. 23, 1999

[54] SEALING STRUCTURE FOR OUTBOARD MOTOR

[75] Inventor: Masashi Takayanagi, Hamamatsu, Japan

[73] Assignee: Suzuki Kabushiki Kaisha, Hamamatsu, Japan

[21] Appl. No.: 19,206

[22] Filed: Feb. 5, 1998

[30] Foreign Application Priority Data

Feb. 6, 1997 [JP] Japan ..... 9-024185

[51] Int. Cl.[6] ..... B63H 21/24

[52] U.S. Cl. ..... 440/77; 123/195 C

[58] Field of Search ..... 440/76, 77, 900; 123/195 C, 195 P; 277/641, 642

[56] References Cited

U.S. PATENT DOCUMENTS 5,069,643 12/1991 Westburg et al. ..... 440/77

*Primary Examiner*—Ed L. Swinehart

*Attorney, Agent, or Firm*—Finnegan, Henderson, Farabow, Garrett & Dunner, L.L.P.

[57] ABSTRACT

A sealing structure is provided for an outboard motor in which an engine is disposed on an upper portion of an engine holder in a state of an outboard motor mounted to a hull, an oil pan is mounted to a lower portion of the engine holder, and the engine, the engine holder and the oil pan are covered with an engine cover unit. The sealing structure for an outboard motor for providing a waterproof sealing portion comprises a seal flange provided for at least either one of the engine holder and the oil pan so as to project outward, a sealing member formed of an elastic material and mounted to the seal flange from an outside portion thereof, a horizontal rib horizontally projecting in a mounted state over an inner surface of the engine cover so as to be brought into contact to either one of upper and lower surfaces of the sealing member, and a plurality of vertical ribs disposed at a side opposite to the horizontal rib with respect to the seal flange, the vertical rib vertically projecting in a mounted state over the inner surface of the engine cover with the sealing member being interposed and clamped between the horizontal rib and the vertical rib.

7 Claims, 12 Drawing Sheets

SEALING STRUCTURE FOR OUTBOARD MOTOR

BACKGROUND OF THE INVENTION

The present invention relates to a sealing structure for an outboard motor.

A conventional small-size outboard motor is shown in FIG. 11, in an state to be mounted to a hull, as a right-hand side view, the outboard motor being mounted with a four-stroke-cycle engine. In FIG. 11, an outboard motor 100 comprises an engine 101 having a lower portion in which an oil pan 102 and a drive-shaft housing 103 are vertically disposed. The engine 101 and the oil pan 102 are covered with an engine cover unit 104.

The engine cover unit 104 is made of synthetic resin and composed of a lower cover 104*a* secured to the oil pan 102 and an upper cover 104*b* detachably joined above the lower cover 104*a*, which is formed to be separated into right and left cover sections.

A waterproof sealing portion 105 is provided for the lowermost portion of the lower cover 104*a*. The waterproof sealing portion 105 fluid-tightly seals between the lower end of the lower cover 104*a* and the oil pan 102 to prevent introduction of water from outside. Thus, the water-proof sealing portion 105 makes the engine 101 and oil pan 102 to be waterproof.

The oil pan 102 has a plurality of external access portions such as a drain hole 106 for discharging oil and a mounting frame 107 for receiving a mounting portion, not shown, for establishing the connection between the overall body of the outboard motor 100 and the hull. The waterproof sealing portion 105 is arranged below the external access portions 106 and 107.

FIG. 12 is an enlarged view of the waterproof sealing portion 105. As shown in FIG. 12, upper and lower horizontal ribs 109 and 110 projecting inwards are formed in the lowermost portion of the lower cover 104*a* around the inner surface thereof. An outer portion of a seal portion 111 made of an elastic material, such as rubber, is held between the upper and lower horizontal ribs 109 and 110.

On the other hand, two stepped portions 112 and 113 are formed in the upper portion of the drive-shaft housing 103. The inner portion of the seal portion 111 is received in a groove 115 formed between the upper step 113 and a flange 114 formed at the lowermost end of the oil pan 102. Thus, the space between the lower cover 104*a* and the oil pan 102 is made to be waterproof.

However, in the above-mentioned conventional structure, it is necessary to locate the upper and lower horizontal ribs 109 and 110 which are formed in the lowermost portion of the lower cover 104*a* around the inner surface thereof. Therefore, the lower cover 104*a* cannot easily be molded and thus the manufacturing yield becomes unsatisfactory. Furthermore, the necessity of inserting the seal portion 111 into a space between the upper and lower horizontal ribs 109 and 110 makes worse the assembling workability.

The upper and lower horizontal ribs cause the weight of the lower cover of a large-size outboard motor to be enlarged, and furthermore, there arises a problem in that the upper and lower horizontal ribs requiring large spaces prevent arbitrary layout.

The lower cover 104*a* has access holes, not shown, in FIG. 11 corresponding to the external access portions which are the drain hole 106 of the oil pan 102 and the mounting frame 107. Since the waterproof sealing portion 105 is formed below the above-mentioned access holes, waterproof sealing structures must be provided for the access holes to prevent introduction of water into the lower cover 104*a*. Therefore, the multiplicity of the sealing structures result in the increasing of the number of elements to be disposed and the increasing of labour of workers.

SUMMARY OF THE INVENTION

An object of the present invention is to substantially eliminate defects or drawbacks encountered in the prior art described above and to provide a sealing structure for an outboard motor capable of simplifying the structures of the engine cover and associated portions or members around the engine, facilitating the molding process, reducing the weight, decreasing the number of the elements, improving assembling workability, permitting arbitrary layout and improving the maintenance thereof, while satisfactory sealing performance of the waterproof sealing portion is realized.

These and other objects can be achieved according to the present invention by providing a sealing structure for an outboard motor in which an engine is disposed on an upper portion of an engine holder in a state of an outboard motor mounted to a hull, an oil pan is mounted to a lower portion of the engine holder, the engine, the engine holder and the oil pan being covered with an engine cover unit, the sealing structure for an outboard motor for providing a waterproof sealing portion of the outboard motor comprising:

- a seal flange provided for at least either one of the engine holder and the oil pan so as to project outward;
- a sealing member formed of an elastic material and mounted to the seal flange from an outside portion thereof;
- a horizontal rib horizontally projecting in a mounted state over an inner surface of the engine cover so as to be brought into close contact to either one of upper and lower surfaces of the sealing member; and
- a vertical rib disposed at a portion opposite to the horizontal rib with respect to the seal flange, the vertical rib vertically projecting in a mounted state over the inner surface of the engine cover with the sealing member being interposed and clamped between the horizontal rib and the vertical rib.

In a preferred embodiment, the horizontal ribs are formed with regions which are in close contact to upper and lower surfaces of the sealing member, respectively, and a plurality of beads extending in a longitudinal direction of the sealing member are formed on surfaces thereof to which the regions of the horizontal ribs are brought into close contact.

The seal flange is formed integrally with the engine holder and the oil pan and is continuously formed from the engine holder to the oil pan so as to provide a height level of the seal flange being varied partially. The seal flange is disposed at a portion upper than external access portions provided for the engine holder and the oil pan.

A waterproof boot for a rod extending downward from the engine may be disposed on an outside portion of the waterproof sealing portion of the engine cover.

According to the present invention of the structures described above, since the sealing member mounted on the seal flange is held between the horizontal rib and the vertical rib so that the sealing member is in close contact to the horizontal rib, and accordingly, an excellent sealing effect can be obtained. Since the horizontal rib is required to be formed on only either one of the upper and lower surfaces of the sealing member, it is not necessary to provide the upper and lower horizontal ribs as has been required with the conventional structure. Thus, the structure of the engine cover can be simplified and easily be molded. As a result, the manufacturing yield can be improved. The horizontal ribs can be decreased, the weight of the engine cover can be reduced. A surplus space can be enlarged, so that the layout of a portion around the engine can easily be determined. Since the sealing member can significantly easily be inserted between the horizontal rib and the vertical rib as compared with insertion of the sealing member between the upper and lower ribs, the assembling operation can easily be performed.

According to the preferred embodiment, the sealing structure enables the horizontal rib to be provided for the portion upper than the sealing member or the portion below the same as necessary. Therefore, the layout of a portion around the engine can arbitrarily be determined. Since the beads are formed on the surface of the sealing member to which the horizontal rib is brought into contact, an excellent sealing characteristic can be realized.

The sealing structure is able to eliminate the necessity of individually providing a seal flange as an independent element. Therefore, the number of elements in a portion around the engine can be reduced.

The sealing structure enables the height of the seal flange to arbitrarily be determined. The layout of a portion around the engine and that of the waterproof sealing portion can further arbitrarily be determined.

The sealing structure is able to omit a sealing structure for each of access holes formed in the engine cover to correspond to the external access portions. Thus, the number of elements can be reduced, thus easily performing the assembling operation.

The sealing structure enables the waterproof boots to be mounted after the engine cover has been mounted. Therefore, the assembling operation and the maintaining operation can easily be performed.

The nature and further characteristic features of the present invention can be made more clear hereinafter from the following descriptions made with reference to the accompanying drawings.

DESCRIPTION OF THE PREFERRED EMBODIMENT

An embodiment of the present invention will be described hereunder with reference to the accompanying drawings.

Figure 1:
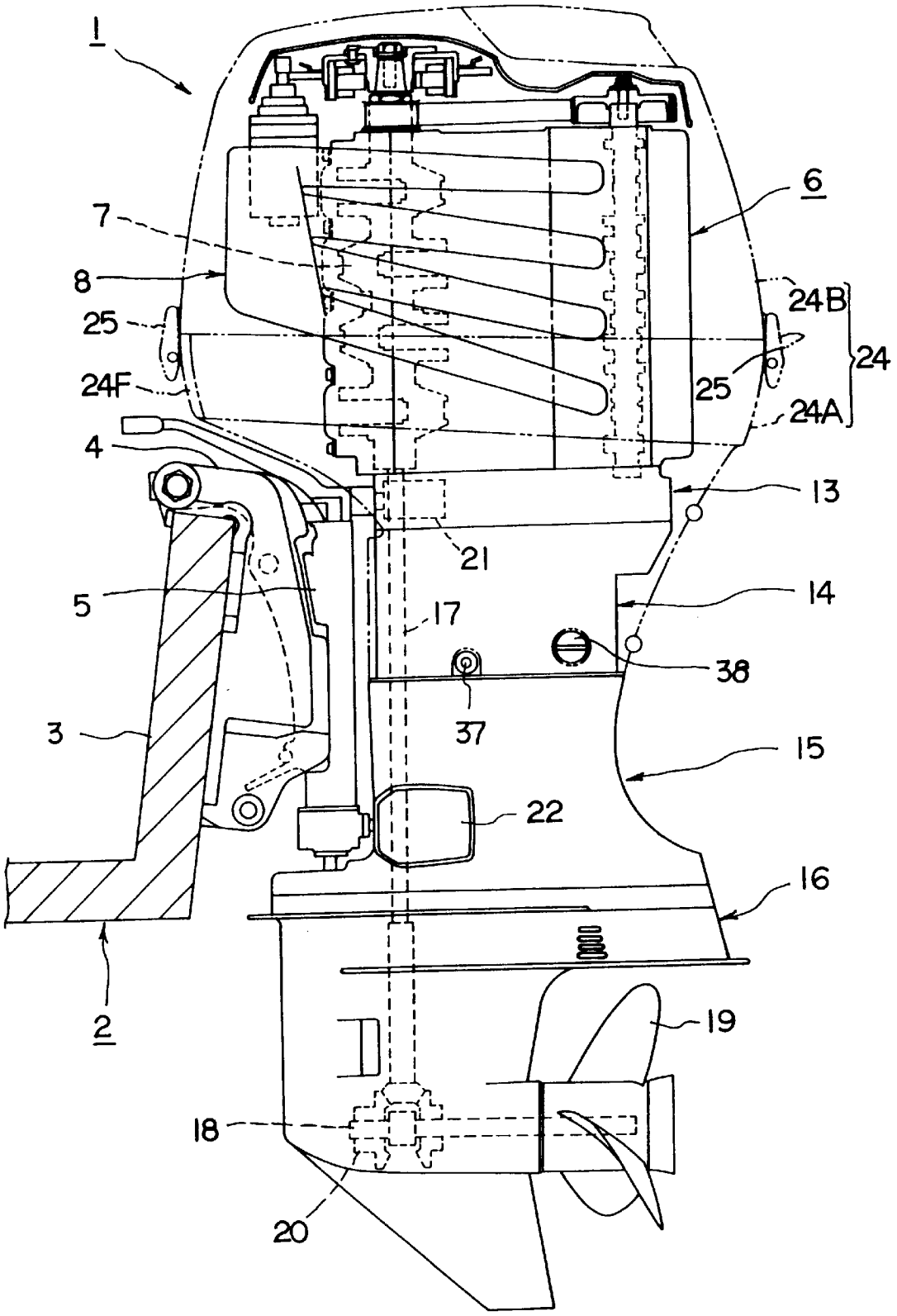
FIG. 1 is a left-hand side view showing an example of an outboard motor having a sealing structure according to the present invention.

FIG. 1 is a left-hand side view showing an example of an outboard motor, in a state to be mounted to a hull, having a sealing structure according to the present invention. An outboard motor 1 is mounted on a transom 3 of a hull 2 through a clamp bracket 4 in such a manner that the outboard motor 1 is able to horizontally rotate about a swivel shaft 5 vertically disposed in the rear portion of the clamp bracket 4.

An engine 6 mounted on the uppermost portion of the outboard motor 1 is, for example, an in-line, four-cylinder, water-cooled and four-stroke-cycle gasoline engine, the engine 6 being mounted vertically in such a manner that a crank shaft 7 of the engine 6 is positioned vertically. An air-suction unit 8 is disposed on the left-hand side surface of the engine 6, while an exhaust manifold 9 (see FIG. 3) extending vertically is disposed on the right-hand side surface of the engine 6. Moreover, a starter motor 10 for starting the engine 6 is disposed on the front surface of the engine 6.

An oil pan 14 is secured to the lower portion of the engine 6 through an engine holder 13 formed into a thick plate-like shape. A drive-shaft housing 15 is secured to the lower portion of the oil pan 14, and a gear housing 16 is secured to the lower portion of the drive-shaft housing 15.

A drive shaft 17 extending downwards is connected to the lower end of the crank shaft 7 of the engine 6 in such a manner that the drive shaft 17 rotates integrally with the crank shaft 7. The drive shaft 17 penetrates the engine holder 13, the oil pan 14 and the drive-shaft housing 15 so that the drive shaft 17 reaches the inside portion of the gear housing 16.

On the other hand, a propeller shaft 18 extending longitudinally is supported in the gear housing 16, and a propeller 19 is connected to the rear end of the propeller shaft 18 to be rotatable together therewith. A bevel gear mechanism 20 disposed at the intersection between the drive shaft 17 and the propeller shaft 18 transmits rotations of the drive shaft 17 to the propeller shaft 18 to thereby rotate the propeller 19.

Further, a pair of right and left, mounting portions 21 and 22 are formed in the front ends of the engine holder 13 and the drive-shaft housing 15. The vertical mounting portions 21 and 22 are pivotally supported at the upper and lower ends of the swivel shaft 5.

Figure 2:
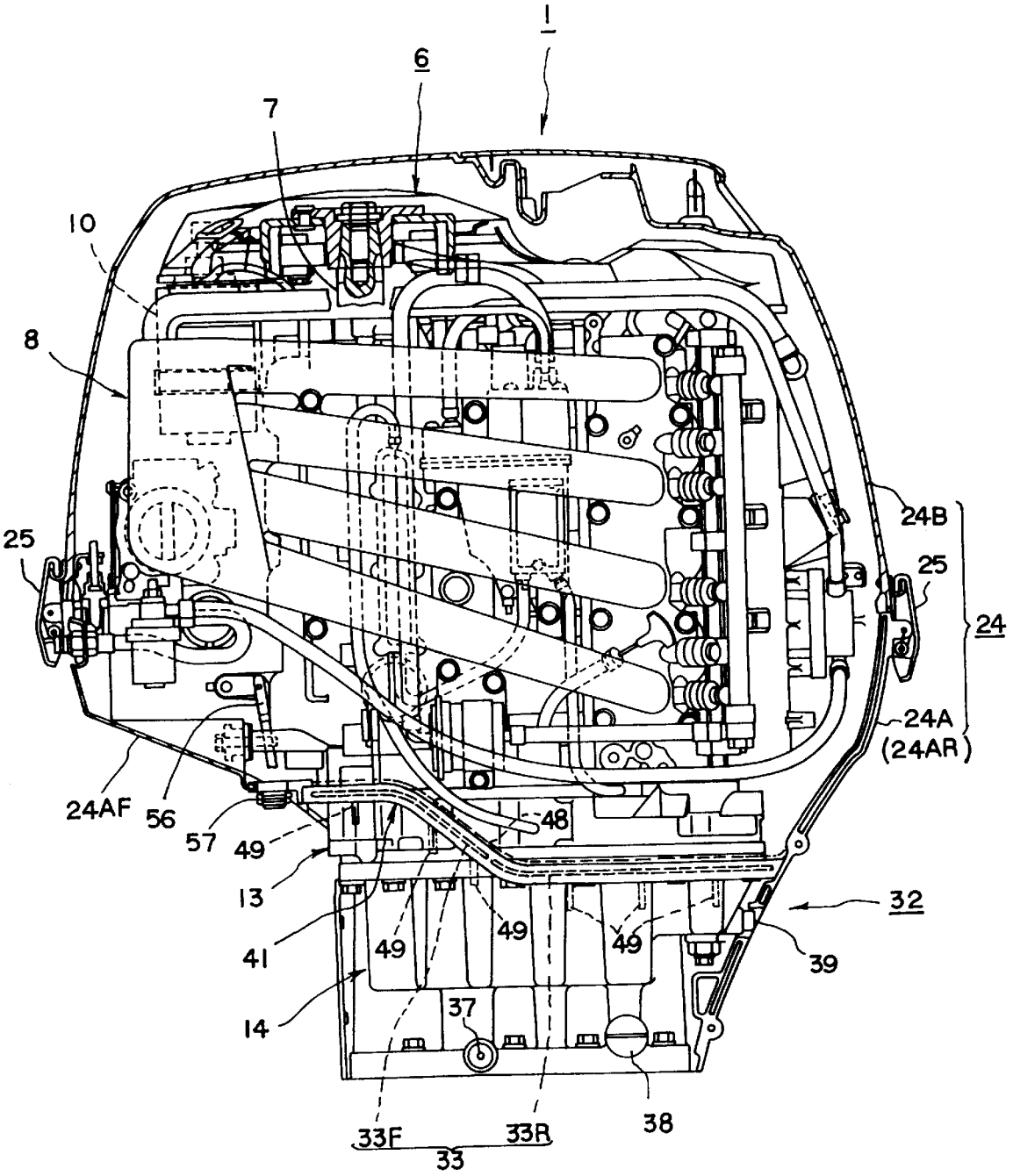
FIG. 2 is a left-hand side view showing an upper portion of the outboard motor.
Figure 3:
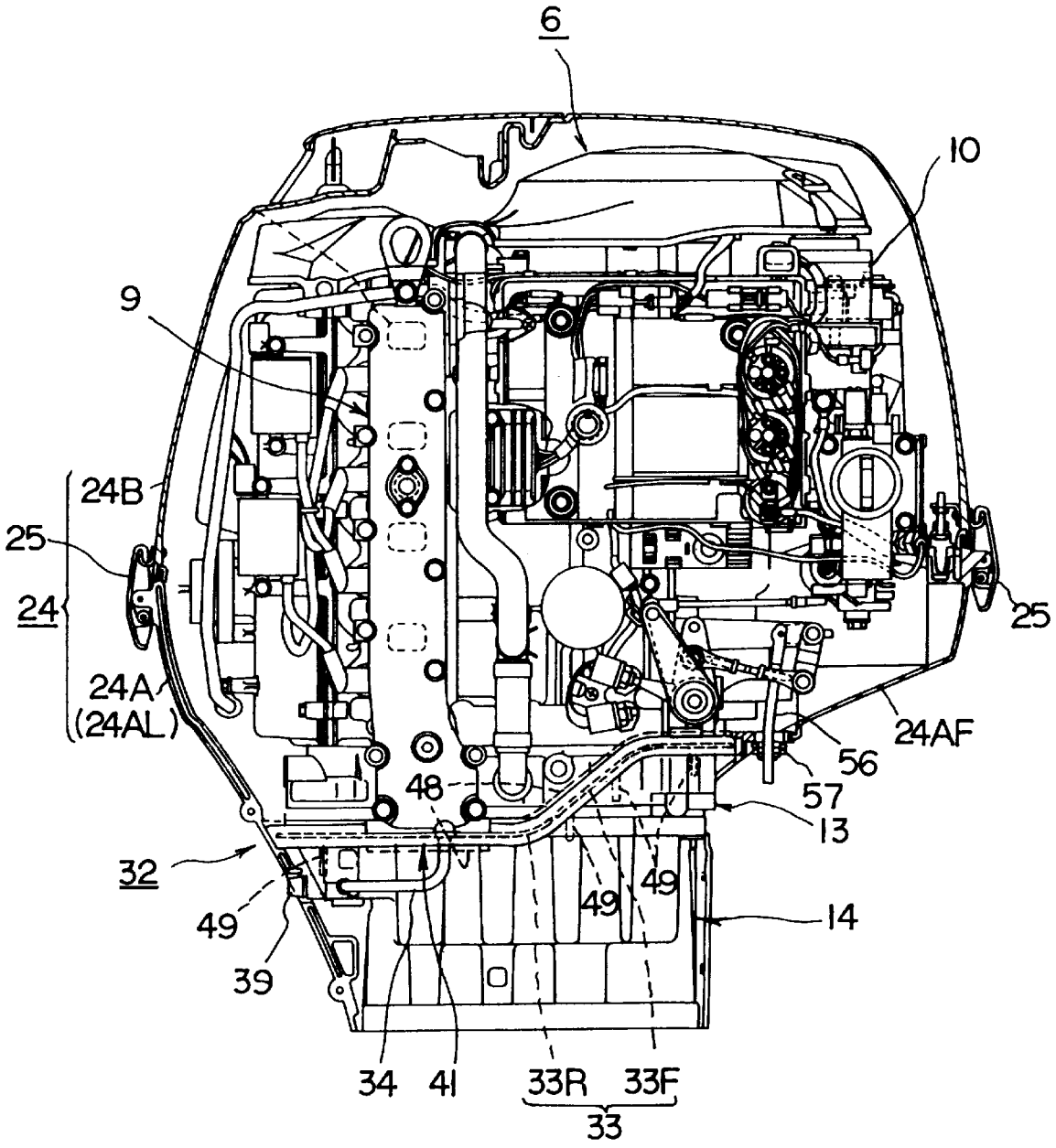
FIG. 3 is a right-hand side view showing an upper portion of the outboard engine.
Figure 4:
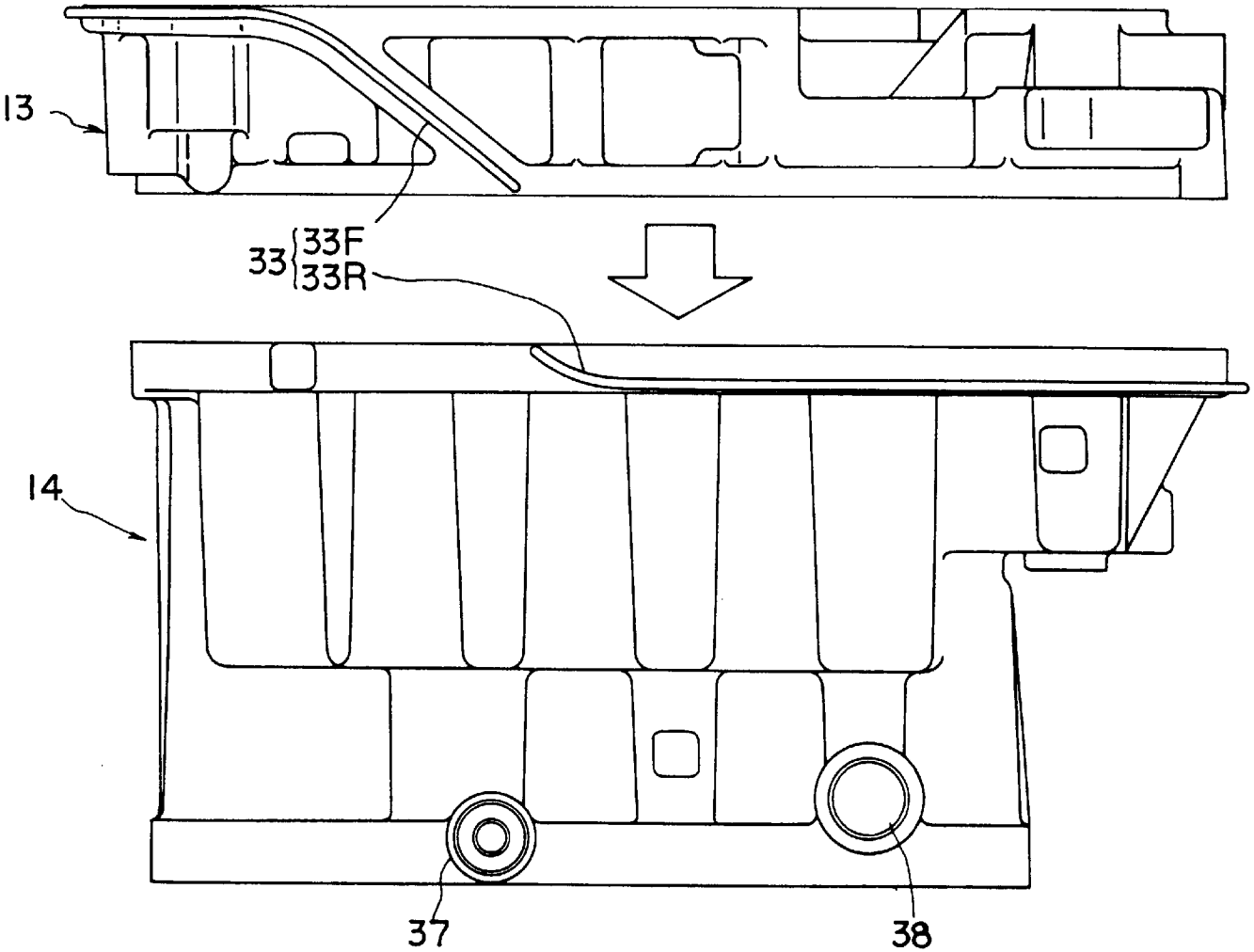
FIG. 4 is a left-hand side view showing an engine holder and an oil pan.

As shown in FIGS. 2 and 3, the engine 6, the engine holder 13 and the oil pan 14 are covered with an engine cover unit 24 made of synthetic resin. The engine cover unit 24 has a structure which can be separated vertically into a lower cover 24A secured across the engine holder 13 and the oil pan 14 and an upper cover 24B detachably joined above the lower cover 24A. When an operation for maintaining the engine 6 or the like is performed, the upper cover 24B is removed. Further, the lower cover 24A and the upper cover 24B are secured together by means of locking levers 25 disposed in the front and rear portions thereof.

Figure 9:
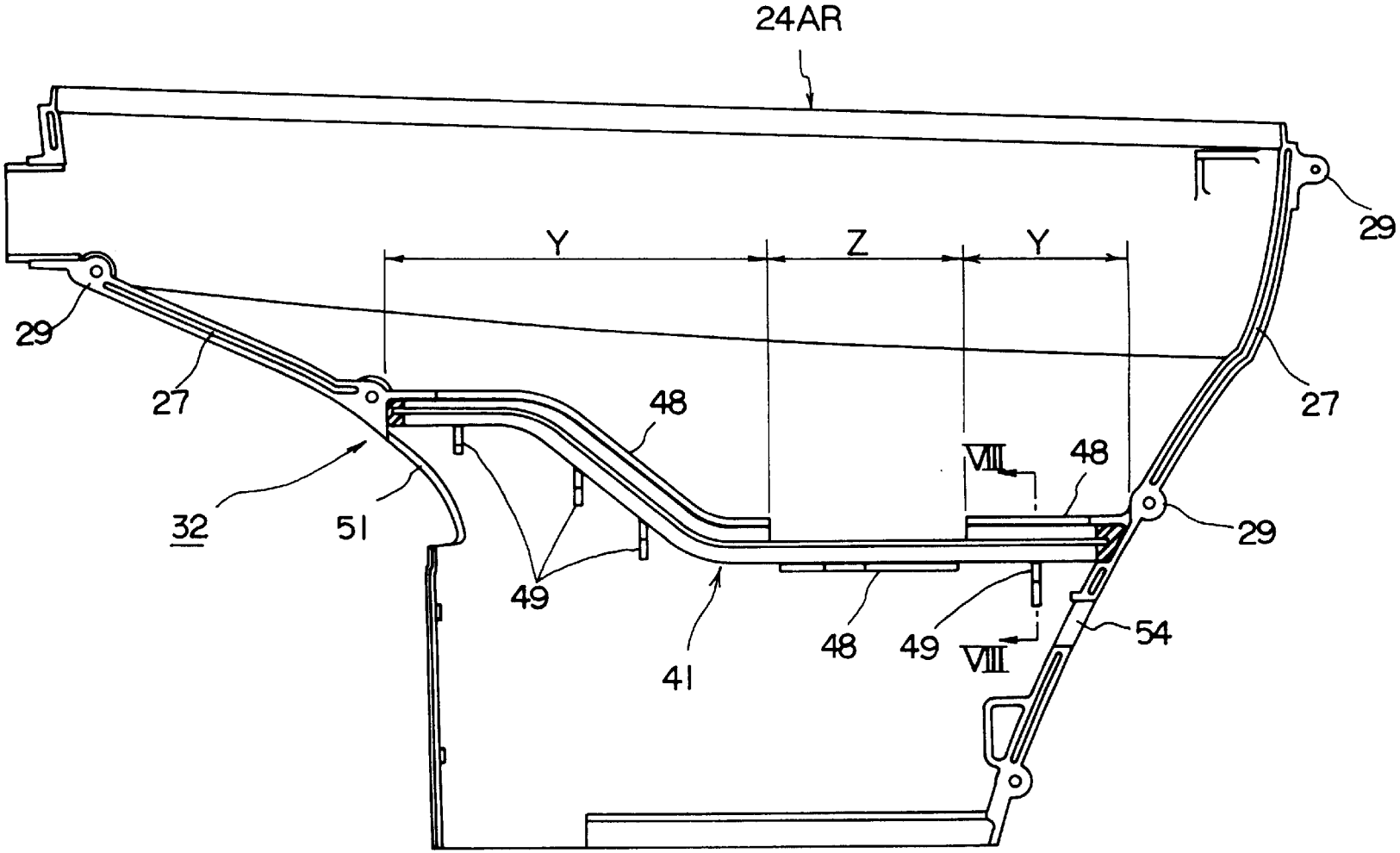
FIG. 9 is a diagram showing a right-hand side cover as viewed from an internal position.
Figure 10:
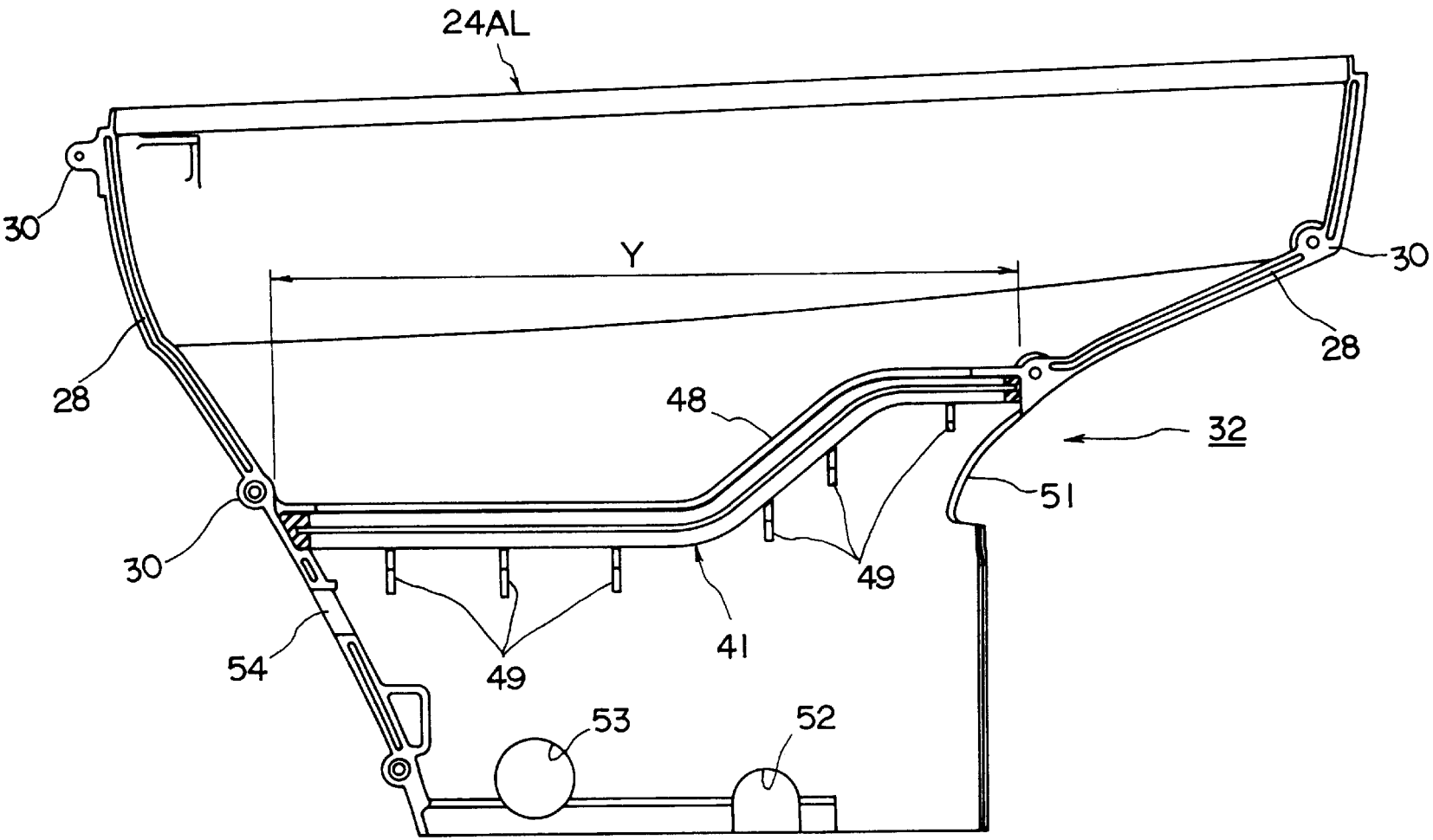
FIG. 10 is a diagram showing a left-hand side cover as viewed from an internal position.
Figure 11:
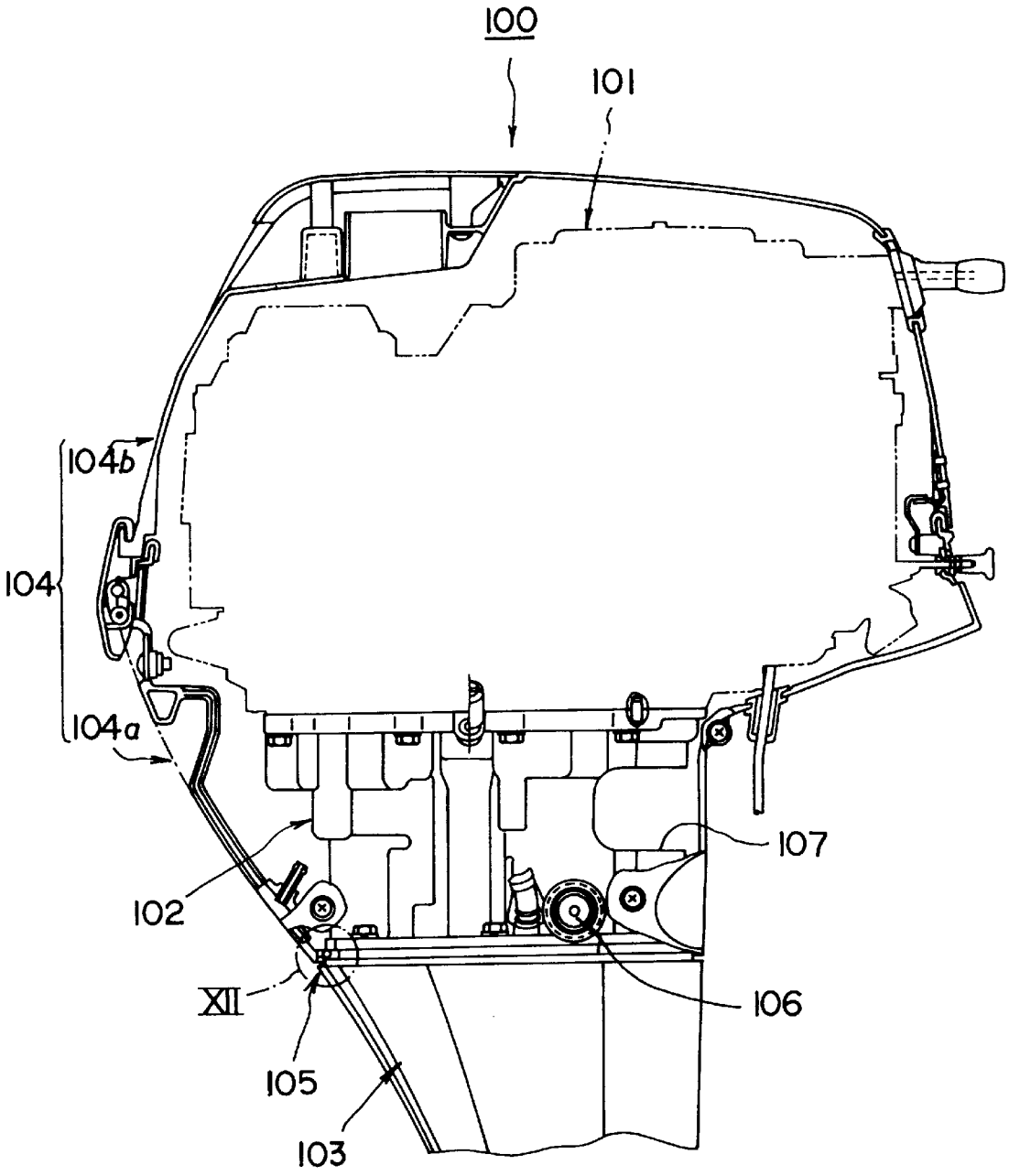
FIG. 11 PRIOR ART
FIG. 11 is a right-hand side view showing an outboard motor having a conventional structure.
Figure 12:
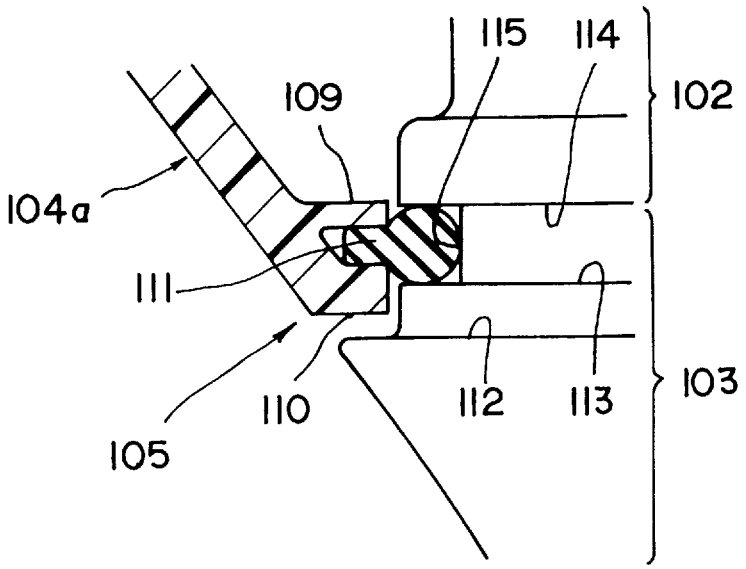
FIG. 12 PRIOR ART
FIG. 12 is an enlarged view showing portion XII shown in FIG. 11.

The lower cover 24A has a structure which can be sectioned into a right-hand side cover section 24AR (see FIGS. 2 and 9) and a left-hand side cover section 24AL (see FIGS. 3 and 10). An individual front cover section 24AF is disposed in front of the right- and left-hand side cover sections 24AR and 24AL.

A joining surface between the right-hand side cover section 24AR and the left-hand side cover section 24AL will now be described. A projection 27 formed in the lengthwise direction of the joining surface is provided for the right-hand side cover section 24AR, while a recess 28 formed in the lengthwise direction of the joining surface is provided for the left-hand side cover section 24AL. Moreover, the right-hand side cover section 24AR has a plurality of fastening pieces 29, while the left-hand side cover section 24AL has a plurality of fastening pieces 30, which are clamped by means of, for example, screws.

When the right and left side covers section 24AR and 24AL have been superimposed, the projection 27 is received by the recess 28 so that the right and left side cover sections 24AR and 24AL are located. Then, screws, not shown, are inserted into the fastening pieces 29 so as to be driven into the fastening pieces 30. Thus, the right and left side cover sections 24AR and 24AL are integrated. Then, the front cover section 24AF is mounted.

A waterproof sealing portion 32 is formed in the lower portion of the lower cover 24A in which the engine holder 13 and the oil pan 14 are joined to each other. The waterproof sealing portion 32 having the sealing structure according to the present invention will be described hereunder.

As shown in FIGS. 2 to 8, a brim-like seal flange 33 projecting toward outside is formed around the engine holder 13 and the oil pan 14. The seal flange 33 has a front flange piece 33F formed integrally with the engine holder 13 and a rear flange piece 33R formed integrally with the oil pan 14.

The front flange piece 33F is formed from the front surface of the engine holder 13 along the upper end of the engine holder 13 to reach the side portion of the engine holder 13. The rear portion of the front flange piece 33F is inclined downwards so as to be terminated at the lower end of the engine holder 13. On the other hand, the rear flange piece 33R extends rearward from an intermediate positions of the right- and left-hand side surfaces of the oil pan 14 to reach the rear surface of the oil pan 14. The front portion of the rear flange piece 33R is warped upwardly.

When the engine holder 13 and the oil pan 14 are Joined to each other, the front flange piece 33F and the rear flange piece 33R are smoothly connected to each other. As a result, the seal flange 33 is continuously formed from the engine holder 13 to the oil pan 14. The right-hand side portion of the rear flange piece 33R has a cutout portion 35 through which a test-water pipe 34 shown in FIG. 3 is allowed to pass.

As described above, the front flange piece 33F is provided for the engine holder 13, while the rear flange piece 33R is provided for the oil pan 14. Therefore, the height of the seal flange 33 varies depending upon the position in such a manner that the front portion of the seal flange 33 is disposed at a higher level and the rear portion of the same is disposed at a lower level. Further, the seal flange 33 is formed at a portion upper than the external access portions which include an opening, not shown, for the mounting portion 21 is secured to the front portion of the engine holder 13, oil-drain ports 37 and flushing ports 38 formed in the side surfaces of the oil pan 14, flushing ports and a passage plug 39 disposed in the rear surface of the oil pan 14. As shown in FIGS. 2, 3 and 6 to 8, a sealing member 41 is joined around the seal flange 33 in a shape like a chenile. The sealing member 41 is made of an elastic material, such as rubber, and arranged to have a cross sectional shape with which the sealing member 41 can be joined to the seal flange 33 from outside.

Figure 7:
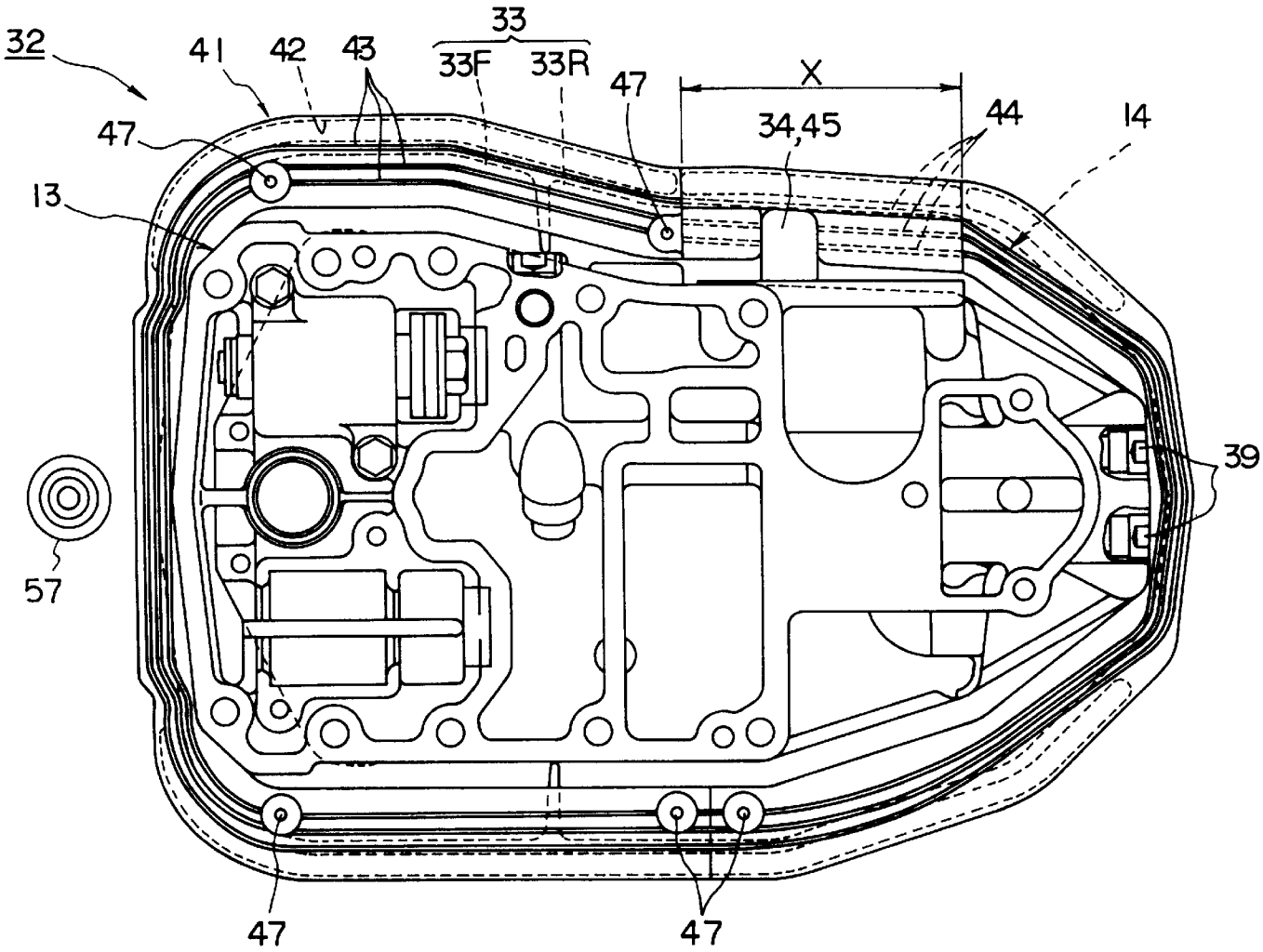
FIG. 7 is a plan view showing the engine holder and the oil pan according to the present invention to which the sealing member is mounted.
Figure 8:
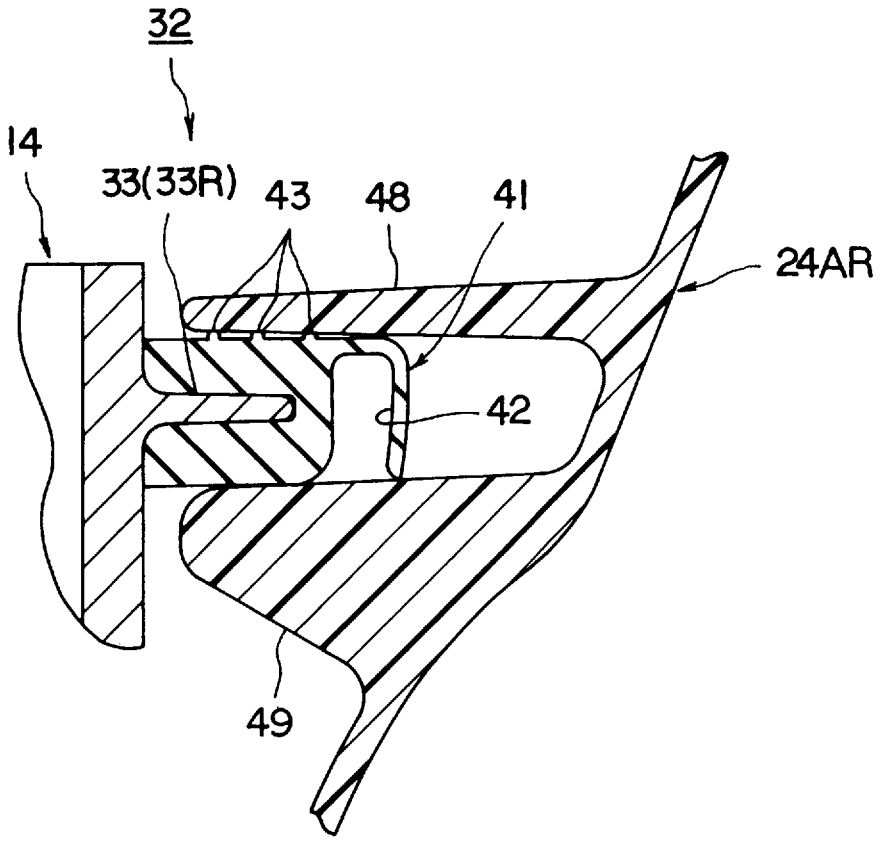
FIG. 8 is a vertical cross sectional view taken along the line VIII—VIII shown in FIG. 9.

As shown in FIGS. 7 and 8, a rip portion 42 extending downwards for cutting water is formed along an outer peripheral edge of the sealing member 41. Three beads 43 are formed on the upper surface of the sealing member 41 except for region X. In the region X, another three beads 44 are formed on the lower surface of the sealing member 41 and an upper side surface thereof in this region X is cut to provide a small thickness portion (see FIG. 3). In addition, a cutout portion 45 corresponding to the cutout portion 35 of the seal flange 33 is formed in the region X.

Figure 5:
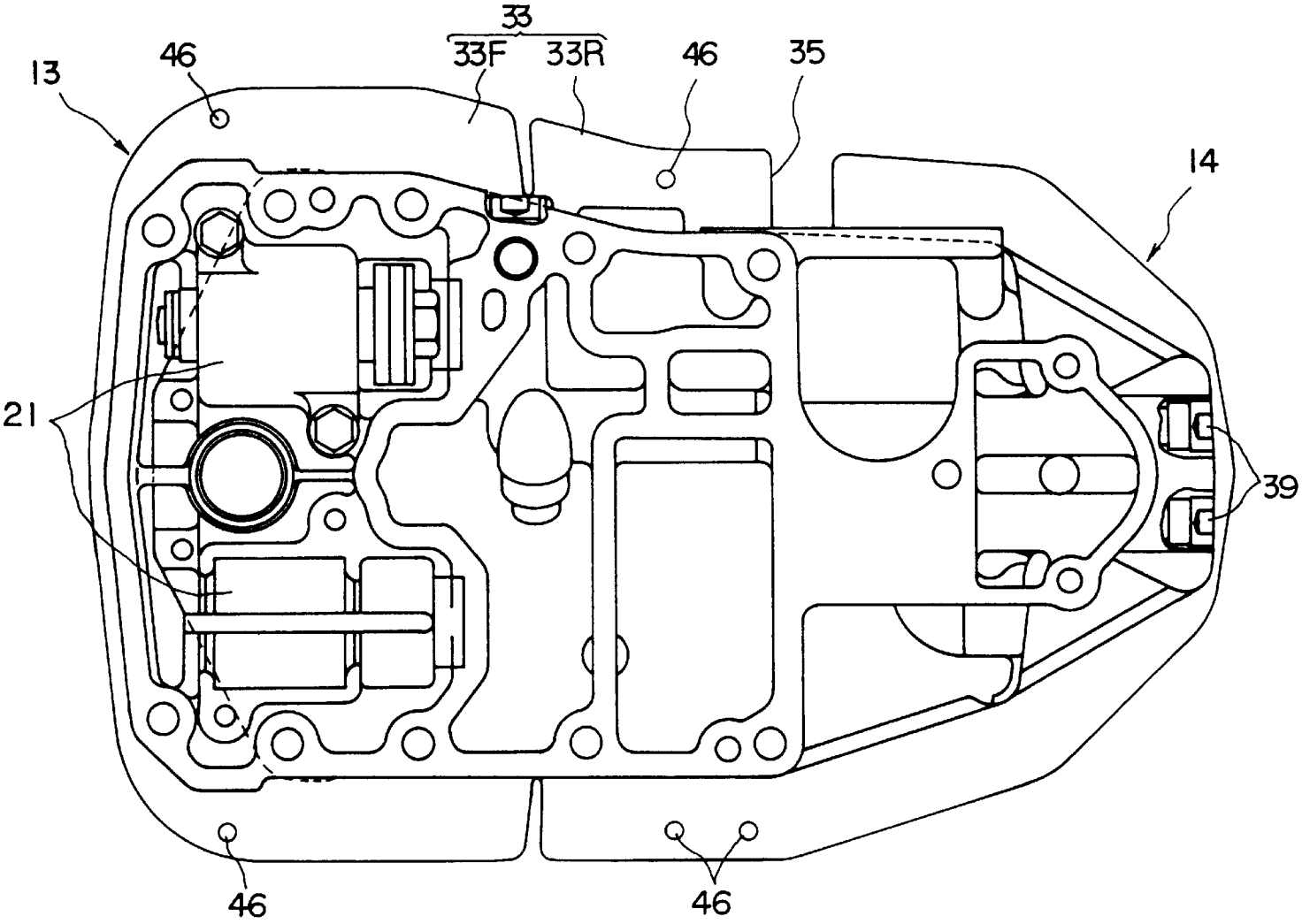
FIG. 5 is a plan view showing the engine holder and the oil pan.
Figure 6:
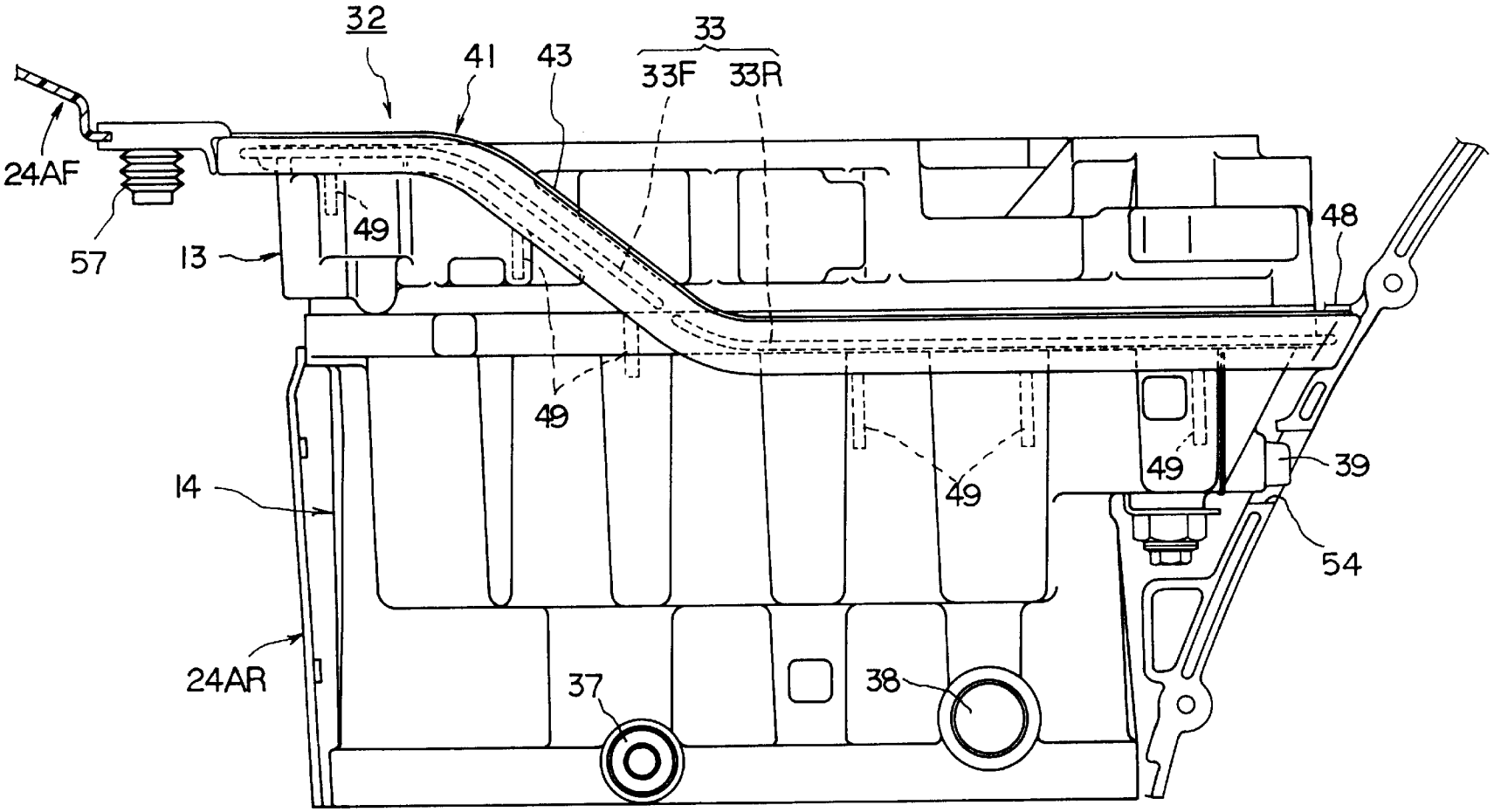
FIG. 6 is a left-hand side view showing the engine holder and the oil pan to which a sealing member is mounted.

As shown in FIG. 5, the seal flange 33 is formed with a plurality of engagement holes 46, with which engaging portions 47 (see FIG. 7) formed in the sealing member 41 are engaged so as to prevent the sealing member 41 from separating from the seal flange 33.

On the other hand, as shown in FIGS. 2, 3 and 8 to 10, a horizontal rib 48 having a shelf-like shape and extending inwards is formed to project over the inner surfaces of the right-hand side cover section 24AR and the left-hand side cover section 24AL forming the lower cover 24A. The horizontal rib 48 is formed around the inner surface of the lower cover 24A to extend in the lengthwise direction of the sealing member 41 joined to the seal flange 33.

As shown in FIGS. 9 and 10, major region Y of the horizontal rib 48 is formed to be close contact to the upper surface of the sealing member 41. Region Z of the horizontal rib 48 formed on the right-hand side cover section 24AR is in close contact to the lower surface of the sealing member 41. The region Z of the horizontal rib 48 coincides with the region X of the sealing member 41.

A plurality of vertical ribs 49 are formed to project over the inner surfaces of the right-hand side cover section 24AR and the left-hand side cover section 24AL. The vertical ribs 49 are formed opposite to the horizontal rib 48 with the seal flange 33 being interposed therebetween. The vertical ribs 49 are omitted from a portion corresponding to the region Z of the horizontal rib 48.

The right- and left-hand side cover sections 24AR and 24AL are formed with access holes 51 to 54 corresponding to an opening (not shown) for the mounting portion 21 of the engine holder 13, the oil-drain port 37, the flushing port 38 of the oil pan 14 and the passage plug 39. The horizontal rib 48 and the vertical ribs 49 are formed at portions upper than the locations of the access holes 51 to 54.

The sealing member 41 joined to the seal flange 33 is interposed between the horizontal rib 48 and the vertical ribs 49 provided for the right-hand and left-hand side cover sections 24AR and 24AL. As a result, the region Y of the horizontal rib 48 is brought into close contact to the upper surface of the sealing member 41. Moreover, the region Z of the horizontal rib 48 is brought into close contact to the lower surface of the sealing member 41. As a result, an excellent sealing effect can be obtained.

As described above, the three beads 43 and 44 are formed in the portion of the sealing member 41 to which the horizontal rib 48 is in close contact. Moreover, the rip portion 42 is formed in the outer periphery of the sealing member 41 to further improve the sealing effect.

As shown in FIG. 3, the lower portion of the exhaust manifold 9 secured to the right-hand side surface of the engine 6 is connected to the right-hand surface of the engine holder 13. As a result, exhaust gas which flows in the exhaust manifold 9 is then caused to flow downward in an exhaust passage formed in the engine holder 13 and the oil pan 14.

The lower end of the exhaust manifold 9 is positioned just above the region X (see FIG. 7) of the sealing member 41. As described above, the upper portion of the sealing member 41 is recessed (see FIG. 3) in the region X. Moreover, the region Z (see FIG. 9) of the horizontal rib 48 provided for the right-hand side cover section 24AR is not in close contact to the upper surface of the sealing member 41, that is, the region Z is in close contact to the lower surface of the sealing member 41. Therefore, interference of the sealing member 41 and the horizontal rib 48 with the exhaust manifold 9 can be prevented.

As shown in FIGS. 2 and 3, a shift rod 56 is disposed so as to extend downward from the engine 6 to be connected to a bevel gear mechanism 20 disposed in the gear housing 16. Waterproof boots 57 are provided for a portion in which the shift rod 56 penetrates the lower cover 24A, i.e. the front cover section 24AF. The waterproof boots 57 are disposed on the outside of the waterproof sealing portion 32 as viewed in a plan view.

Since the waterproof sealing portion 32 has the above-mentioned structure, the horizontal rib 48 which must be provided for the lower cover 24A is required to be formed on either one of the upper surface of the sealing member 41 or the lower surface thereof. Therefore, the structure of the lower cover 24A can be simplified and the operation for molding the same can easily be performed. As a result, the manufacturing yield can be improved. Since the horizontal rib 48 can be decreased, the weight can be reduced. Further, since a surplus space is created in the portion around the horizontal rib 48, the layout of a portion around the engine 6 can arbitrarily be determined. Since the sealing member 41 can easily be inserted between the horizontal rib 48 and the vertical ribs 49, the lower cover 24A can easily be mounted.

The horizontal rib 48 has the region Y which is brought into close contact to the upper surface of the sealing member 41 and the region Z which is brought into close contact to the lower surface of the molding member 41. Since the horizontal rib 48 is provided for the upper surface or the lower surface of the sealing member 41 as required, the layout of the portion around the engine 6 can arbitrarily be determined. For example, this embodiment enables the exhaust manifold 9 to extend downward without interference with the horizontal rib 48 disposed in the region Z. Since the beads 43 and 44 are formed on the surface of the molding member 41 to which the horizontal rib 48 is in close contact, an excellent sealing effect can be realized.

Furthermore, since the seal flange 33 is integrally formed with the engine holder 13 and the oil pan 14, it is not necessary to individually locate the seal flange 33, and as a result, the number of elements required to be disposed in the vicinity of the engine 6 can be reduced. Moreover, the seal flange 33 may be used as a member for increasing the strength of the engine holder 13 and the oil pan 14.

Since the seal flange 33 is continuously formed from the engine holder 13 to the oil pan 14 in such a manner that the height of the seal flange 33 varies depending upon the positions, the height of the seal flange 33 can arbitrarily be determined. Thus, the layout of the portion around the engine 6 and the layout including the engine holder 13 and the waterproof sealing portion 32 can arbitrarily be determined.

Still furthermore, since the seal flange 33 is disposed at a portion upper than the external access portions (37, 38, 39 and the like) formed in the engine holder 13 and the oil pan 14, it is not necessary to provide a sealing structure to each of the access holes 51 to 54 formed in the lower cover 24A at positions corresponding to these external access portions. Therefore, the number of elements can significantly be reduced and the operation for assembling the elements can easily be performed.

Still furthermore, since the waterproof boots 57 of the shift rod 56 extending downwards from the engine 6 are, in a plan view, disposed on the outside of the waterproof sealing portion 32, the rods and waterproof boots can be mounted after the lower cover 24A has been mounted on the engine holder 13 and the oil pan 14. As a result, the assembling operation and the maintenance operation can easily be performed.

Although, in the described embodiment, the seal flange 33 is continuously formed from the engine holder 13 to the oil pan 14, the seal flange 33 may be provided for only either one of the engine holder 13 or the oil pan 14 depending on the layout of elements of the outboard motor.

It is to be noted that the present invention is not limited to the described embodiment and many other changes and modifications may be made without departing from the scopes of the appended claims.

What is claimed is:

1. A sealing structure for an outboard motor in which an engine is disposed on an upper portion of an engine holder in a state of an outboard motor mounted to a hull, an oil pan is mounted to a lower portion of the engine holder, said engine, said engine holder and said oil pan being covered with an engine cover unit, said sealing structure for an outboard motor for providing a waterproof sealing portion of the outboard motor comprising:

a seal flange provided for at least either one of the engine holder and the oil pan so as to project outward;

a sealing member formed of an elastic material and mounted to said seal flange from an outside portion thereof;

a horizontal rib horizontally projecting in a mounted state over an inner surface of the engine cover so as to be brought into contact to either one of upper and lower surfaces of the sealing member; and a vertical rib disposed at a portion opposite to said horizontal rib with respect to said seal flange, said vertical rib vertically projecting in a mounted state over the inner surface of the engine cover with said sealing member being interposed and clamped between said horizontal rib and said vertical rib.

2. A sealing structure for an outboard motor according to claim 1, wherein said horizontal rib is formed with regions which are in contact to upper and lower surfaces of said sealing member, respectively, and a plurality of beads extending in a longitudinal direction of said sealing member are formed on surfaces thereof to which said regions of the horizontal rib are brought into contact.

3. A sealing structure for an outboard motor according to claim 1, wherein said seal flange is formed integrally with the engine holder and the oil pan.

4. A sealing structure for an outboard motor according to claim 3, wherein said seal flange is continuously formed from the engine holder to the oil pan so as to provide a height level of the seal flange being varied partially.

5. A sealing structure for an outboard motor according to 3, wherein said seal flange is disposed at a portion upper than external access portions provided for the engine holder and the oil pan.

6. A sealing structure for an outboard motor according to claim 1, wherein said horizontal rib and said vertical rib are disposed in plural numbers.

7. A sealing structure for an outboard motor according to claim 1, further comprising a waterproof boot for a rod extending downward from the engine disposed on an outside portion of said waterproof sealing portion of the engine cover.

* * * * *